US011646136B2

(12) United States Patent
Sasaki et al.

(10) Patent No.: US 11,646,136 B2
(45) Date of Patent: May 9, 2023

(54) CHIP RESISTOR AND METHOD OF MANUFACTURING CHIP RESISTOR

(71) Applicant: KOA CORPORATION, Ina (JP)

(72) Inventors: Homare Sasaki, Ina (JP); Yasuhiro Kamijo, Ina (JP)

(73) Assignee: KOA CORPORATION, Ina (JP)

( * ) Notice: Subject to any disclaimer, the term of this patent is extended or adjusted under 35 U.S.C. 154(b) by 0 days.

(21) Appl. No.: 17/703,798

(22) Filed: Mar. 24, 2022

(65) Prior Publication Data

US 2022/0319745 A1 Oct. 6, 2022

(30) Foreign Application Priority Data

Apr. 5, 2021 (JP) ..... JP2021-064208

(51) Int. Cl.

| | |
|---|---|
| ***H01C 7/00*** | (2006.01) |
| ***H01C 17/00*** | (2006.01) |
| ***H01C 17/22*** | (2006.01) |
| ***H01C 1/14*** | (2006.01) |

(52) U.S. Cl.

CPC ..... *H01C 7/003* (2013.01); *H01C 1/14* (2013.01); *H01C 17/006* (2013.01); *H01C 17/22* (2013.01)

(58) Field of Classification Search

CPC ..... H01C 17/006; H01C 17/22; H01C 17/24; H01C 17/242; H01C 7/003; H01C 1/14

See application file for complete search history.

(56) References Cited

U.S. PATENT DOCUMENTS

| | | | | |
|---|---|---|---|---|
| 5,043,694 | A * | 8/1991 | Higashi | H01C 17/24 338/195 |
| 5,874,887 | A * | 2/1999 | Kosinski | H01C 17/245 338/195 |
| 6,007,755 | A * | 12/1999 | Hoshii | H01C 17/24 338/195 |
| 6,084,502 | A * | 7/2000 | Ariga | H01C 17/23 338/195 |
| 6,292,091 | B1 * | 9/2001 | Kambara | H01C 17/242 338/195 |
| 6,462,304 | B2 * | 10/2002 | Kaida | H01C 17/242 338/195 |
| 7,940,158 | B2 * | 5/2011 | Yoneda | H01C 17/006 338/307 |
| 9,460,834 | B2 * | 10/2016 | Croci | H01C 17/24 |

(Continued)

FOREIGN PATENT DOCUMENTS

JP 2019-201142 A 11/2019

*Primary Examiner* — Kyung S Lee
(74) *Attorney, Agent, or Firm* — Oliff PLC

(57) ABSTRACT

A chip resistor includes an insulated substrate having a rectangular parallelepiped shape, a first front electrode and a second front electrode created on both longitudinal ends of the insulated substrate, and a resistive element making a connection between the first and second front electrodes. The resistive element is formed in a meandering shape with a first region and a second region continuing in series via a jointing section between a pair of connecting portions. Moreover, in the first region, a first trimming groove for rough adjustment is formed to elongate a current path of the resistive element. In the second region, a second trimming groove is formed for fine adjustment extending in a direction angled with respect to a straight line along a direction in which the first trimming groove extends.

11 Claims, 5 Drawing Sheets

(56) References Cited

U.S. PATENT DOCUMENTS

| | | | | |
|---|---|---|---|---|
| 10,242,776 | B2 * | 3/2019 | Morita | H01C 17/06 |
| 11,170,918 | B2 * | 11/2021 | Ushiyama | H01C 7/22 |
| 2021/0249164 | A1 | 8/2021 | Ushiyama et al. | |

* cited by examiner

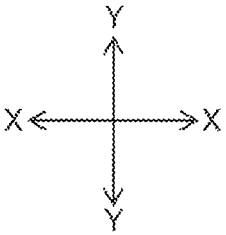
FIG. 2A
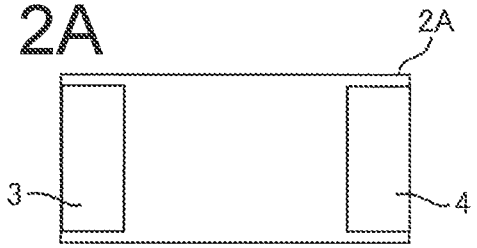
FIG. 2B
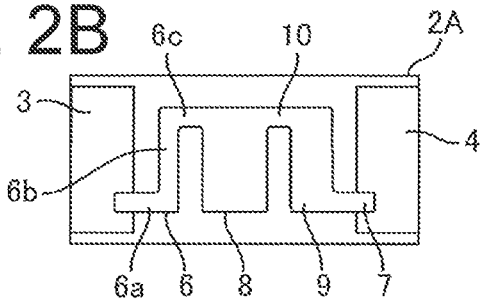
FIG. 2C
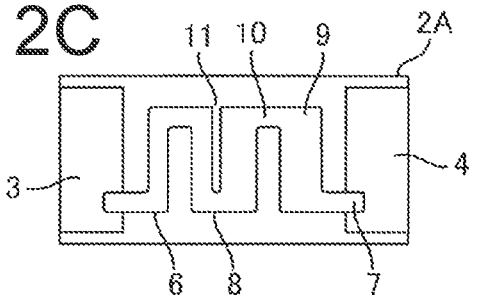
FIG. 2D
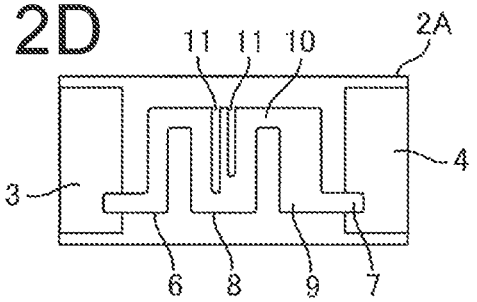
FIG. 2E
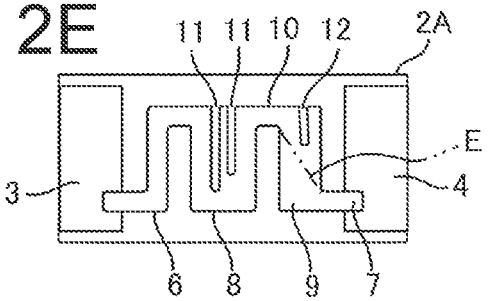

CHIP RESISTOR AND METHOD OF MANUFACTURING CHIP RESISTOR

BACKGROUND OF THE INVENTION

(1) Field of the Invention

The present invention relates to a chip resistor whose resistance value is adjusted by forming trimming grooves in a resistive element provided on an insulated substrate and a method of manufacturing such a chip resistor.

(2) Description of the Related Art

A chip resistor is principally comprised of an insulated substrate having a rectangular parallelepiped shape, a pair of front electrodes placed opposing each other across a certain distance on a front surface of the insulated substrate, a pair of back electrodes placed opposing each other across a certain distance on a back surface of the insulated substrate, end face electrodes to bridge the front and back electrodes, a resistive element to bridge the front electrodes paired with each other, a protective layer to cover the resistive element, etc.

Typically, when manufacturing chip resistors as above, forming a large number of electrodes, resistive elements, protective coating layers, etc. onto a large-sized substrate in a single sequence is followed by separating the large-sized substrate along grid-like separation lines (e.g., separation trenches) into a large number of chip resistors. In the process of manufacturing such chip resistors, a large number of resistive elements are formed by printing and firing a resistive paste on one side of the large-sized substrate. It is inevitable that slight variation in the size and film thickness of each resistive element arises due to the influence of misalignment and blurry in printing or temperature irregularity inside a firing furnace among others. Therefore, resistance value adjustment work that forms trimming grooves in each resistive element and sets its resistance to a desired resistance value is performed for the resistive elements being on the large-sized substrate.

When a surge voltage that is produced by, inter alia, static electricity or power supply noise is applied to a chip resistor configured as above, excessive electric stress would occur and have an impact on the resistor characteristics and may destroy the resistor in the worst case. In order to improve anti-surge characteristics, it is known that making a resistive element in a meandering shape to elongate its entire length moderates a potential drop and anti-surge characteristics can be improved.

As related art of this kind, a chip resistor configured as below is proposed (refer to Japanese Unexamined Patent Application Publication No. 2019-201142). As is depicted in FIG. 8, between a pair of front electrodes 101 created on both ends of an insulated substrate 100, printing a resistive element 105 having a meandering shape with a first meandering portion 103 and a second meandering portion 104 continuing in series to both ends across a central adjustment part 102 is performed. I-cut shaped first trimming grooves 106 are formed in the adjustment part 102 to elongate the current path of the resistive element 105. The resistance value of the resistive element 105 is roughly adjusted to a value that is somewhat lower than a target resistance value. Then, an L-cut shaped second trimming groove 107 is formed in the second meandering portion 104 and, thereby, the resistance value of the resistive element 105 is finely adjusted until it matches the target resistance value.

In the related art disclosed in Japanese Unexamined Patent Application Publication No. 2019-201142, by forming the first trimming grooves 106 in the adjustment part 102 of the resistive element 105 formed in a meandering shape by printing, the resistance value of the resistive element 105 is roughly adjusted to approximate to the target resistance value. After that, by forming the L-cut shaped second trimming groove 107 in the second meandering portion 104, the resistance value of the resistive element 105 is finely adjusted to make it match the target resistance value. Thus, the resistance value can be adjusted at high precision with improved anti-surge characteristics.

SUMMARY OF THE INVENTION

In the chip resistor described in Japanese Unexamined Patent Application Publication No. 2019-201142, current passes across the second meandering portion 104 of the resistive element 105 through the shortest path which is depicted by an imaginary line E in FIG. 8; this shortest path E is a location where the largest amount of current flows. The second trimming groove 107 is formed in an area where there is less current distribution. Therefore, if consideration is made so that the extremity of the second trimming groove 107 does not cross the shortest path E, the resistance value of the resistive element 105 can be finely adjusted to make it match the target resistance value, depending on the cut depth of the second trimming groove 107. However, there is variation in initial resistance values of resistive elements 105 that are formed by printing. If an initial resistance value of a resistive element 105 is too low, it is feared that the resistance value of the restive element 105 cannot be increased to fall within a target resistance value range in spite of forming the second trimming groove 107 and yield may decline.

The present invention has been developed in view of actual circumstances as noted above. A first object of the invention resides in providing a chip resistor capable of improving anti-surge characteristics and making a fine resistance value adjustment at high precision. A second object of the invention resides in providing a method of manufacturing such a chip resistor.

In order to achieve the foregoing first object, a chip resistor according to the present invention includes an insulated substrate having a rectangular parallelepiped shape, a pair of electrodes placed opposing each other across a certain distance on the insulated substrate, and a resistive element making a bridge connection between the pair of the electrodes with a trimming groove extending linearly in the resistive element to make a resistance value adjustment. The resistive element is an element formed by printing having connecting portions connecting to the pair of the electrodes and an adjustment part which is rectangular in shape positioned between both the connecting portions. In the adjustment part, a first trimming groove for rough adjustment is formed to elongate a current path of the resistive element and a second trimming groove for fine adjustment is formed to adjust a resistance value after being roughly adjusted by the first trimming groove. A straight line along a direction in which the second trimming grove extends is angled with respect to a straight line along a direction in which the first trimming groove extends.

In the chip resistor thus configured, the first trimming groove is formed in the adjustment part to elongate the current path of the resistive element, so that the resistance value increases depending on the cut depth of the first trimming groove. Thus, the resistance value can be roughly adjusted with improved anti-surge characteristics. In addition, the second trimming groove is formed in an area where there is less current distribution in the adjustment part and, thereby, the resistance value can be finely adjusted at high precision. Moreover, the straight line along the direction in which the second trimming grove extends is angled with respect to the straight line along the direction in which the first trimming groove extends. Thereby, the second trimming groove can be formed to extend long alongside the shortest current path and, therefore, it is possible to make yield improvement with reduced maladjustment of the resistance value.

In the chip resistor configured as above, although both the connecting portions of the resistive element may be a pattern extending linearly, making at least one of the connecting portions as a turn segment extending in a meandering shape elongates the current path of the resistive element and makes it possible to improve anti-surge characteristics.

In addition, in the chip resistor configured as above, although both the first and second trimming grooves may be formed in a single adjustment part, with the adjustment part having a first region and a second region continuing in series via a jointing portion, the first trimming groove formed in the first region, and the second trimming groove formed in the second region, the region where the trimming groove for rough adjustment is formed and the region where the trimming groove for fine adjustment is formed are separated. Consequently, this allows a more precise resistance value adjustment, elongates the current path of the resistive element, and makes it possible to further improve anti-surge characteristics.

In this case, it is preferable to form a plurality of first trimming grooves that are I-cut shaped and have different length dimensions in the first region and doing so allows a rough adjustment of the resistance value of the resistive element at high precision, though there is no particular limitation to the number of first trimming grooves that are formed in the first region.

Here, in a case where two first trimming grooves are formed in the first region, although a second one of the first trimming grooves may be formed in parallel with a first one of the first trimming grooves, one of the first trimming grooves may be angled with respect to the other one of the first trimming grooves. Alternatively, the two first trimming grooves may be formed to extend in opposite directions to each other originating from top and bottom opposing sides of the first region.

Furthermore, in order to achieve the forgoing second object, a method of manufacturing a chip resistor according to the present invention is a method of manufacturing a chip resistor including an insulated substrate, a first electrode and a second electrode placed opposing each other across a certain distance on the insulated substrate, and a resistive element making a bridge connection between the first electrode and the second electrode with a trimming groove extending linearly in the resistive element to make a resistance value adjustment. The resistive element includes an element formed by printing having a turn segment connecting to the first electrode and extending in a meandering shape, a first region which is rectangular in shape and connects to the turn segment, a second region which is rectangular in shape and connects to the second electrode, and a jointing portion making a connection between the first region and the second region. The method includes forming in the first region a first trimming groove for rough adjustment to elongate a current path of the resistive element, subsequently forming in the second region a second trimming groove extending in a direction angled with respect to a straight line along a direction in which the first trimming groove extends, and thereby making a fine adjustment of a resistance value after being roughly adjusted by the first trimming groove so that the resistance value falls within a target resistance value range.

In the method of manufacturing a chip resistor including steps as above, after printing and forming the meandering shaped resistive element with the first region and the second region continuing in series via the jointing portion, the first trimming groove is formed to elongate the current path of the resistive element in the first region, so that the resistance value increases depending on the cut depth of the first trimming groove. Thus, the resistance value can be roughly adjusted with improved anti-surge characteristics. Then, after the first trimming groove is formed, the second trimming groove is formed in the second region in a direction angled with respect to the first trimming groove. Thereby, the second trimming groove can be formed to extend long alongside the shortest current path and, therefore, it is possible to make a fine adjustment of the resistance value at high precision and make yield improvement with reduced maladjustment of the resistance value.

According to the present invention, it is possible to provide a chip resistor capable of improving anti-surge characteristics and making a fine resistance value adjustment at high precision.

BRIEF DESCRIPTION OF THE DRAWINGS

Embodiments of the present invention will be described in detail based on the following figures, wherein:

FIGS. 2A to 2E are explanatory diagrams illustrating a process of manufacturing a chip resistor relevant to the first embodiment;

DETAILED DESCRIPTION OF THE INVENTION

Figure 1:
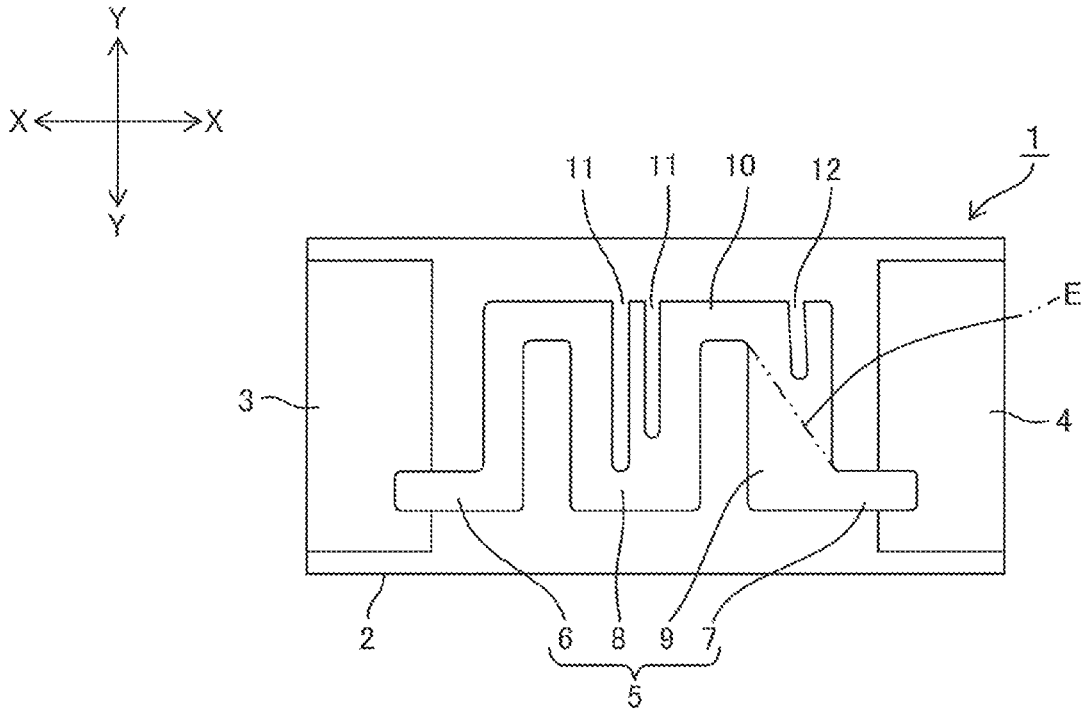
FIG. 1 is a plan view of a chip resistor relevant to a first embodiment.

Embodiments of the invention are described below with reference to the drawings. FIG. 1 is a plan view of a chip resistor relevant to a first embodiment of the present invention.

As is depicted in FIG. 1, the chip resistor 1 relevant to the first embodiment is principally comprised of an insulated substrate 2 having a rectangular parallelepiped shape, a first front electrode 3 and a second front electrode 4 created on both longitudinal ends of the front surface of the insulated substrate 2, a resistive element 5 created on the front surface of the insulated substrate 2 to make a connection between the first and second front electrodes 3 and 4, and a protective coating layer (not depicted) to cover the resistive element 5. Additionally, a pair of back electrodes are created in place to correspond to the first and second front electrodes 3 and 4 on the back surface of the insulated substrate 2, and on the both longitudinal ends of the insulated substrate 2, end face electrodes to bridge the front and back electrodes mating with one another are created, and plated external electrodes are created to cover the end face electrodes, though these electrodes are omitted from the depiction. Note that the following description assumes that a direction going between the first and second front electrodes 3 and 4 is an X direction and a direction orthogonal to the X direction is a Y direction.

The resistive element 5 is formed in a meandering shape with a first region 8 and a second region 9 continuing in series via a jointing section 10 between a pair of connecting portions 6 and 7. Such a meandering shape is defined by a shape into which paste of the resistive element is printed. A connecting portion 6 depicted at left is a turn segment formed in a meandering shape, and this connecting portion 6 makes a connection between the first front electrode 3 and the top edge of the first region 8. In addition, a connecting portion 7 depicted at right is a linear pattern, and this connecting portion 7 makes a connection between the second front electrode 4 and a lower end portion of the second region 9. The first region 8 and the second region 9 are an adjustment part for adjusting the resistance value of the resistive element 5, and these first region 8 and second region 9 are both formed in a rectangular shape. The top edge of the first region 8 and the top edge of the second region 9 are connected via the jointing section 10. The jointing section 10 and both the connecting portions 6 and 7 are set to have a substantially equal pattern width.

Two first trimming grooves 11 with different dimensions in length are formed in the first region 8, and the resistance value of the resistive element 5 is roughly adjusted to approximate to a target resistance value by these first trimming grooves 11. A first longer one of the first trimming grooves 11 is an I-cut shaped slit extending in the Y direction from the top side toward the bottom side of the first region 8. Forming the first trimming groove 11 like this in the first region 8 makes the resistive element 5 in a three-turn meandering shape and elongates the current path. A second shorter one of the first trimming grooves 11 is also an I-cut shaped slit extending in the Y direction from the top side toward the bottom side of the first region 8. The first and second ones of the first trimming grooves 11 extend in parallel with each other. However, the number of the first trimming grooves 11 that are formed in the first region 8 is not limited to two grooves and may be one groove or three or more grooves.

In the second region 9, an I-cut shaped second trimming groove 12 is formed which extends from the top side toward the bottom side of the second region 8 in a direction angled with respect to the Y direction. The resistance value of the resistive element 5 is finely adjusted to approximate to the target resistance value by this second trimming groove 12. Here, the extremity of the second trimming groove 12 is set to a position where it does not cross an imaginary line E connecting the jointing section 10 and the connecting portion 7 depicted at right at the shortest distance. Because a location where the largest amount of current flows within the second region 9 is along the imaginary line E, the second trimming groove 12 is formed in an area where there is less current distribution in the second region 9. Moreover, because the direction in which the second trimming groove 12 extends is angled with respect to the direction (Y direction) in which the first trimming grooves 11 extend, the second trimming groove 12 can be formed to extend long alongside the shortest current path (the imaginary line E). Accordingly, the amount of change in the resistance value depending on the cut depth of the second trimming groove 12 becomes small. It is possible to make a fine adjustment of the resistance value of the resistive element 5 at high precision and make yield improvement with reduced maladjustment of the resistance value.

Next, a description is provided about a process of manufacturing the chip resistor 1 configured as described above, while referring to FIGS. 2A to 2E.

First, the process prepares a large-sized substrate that is separated into a large number of insulated substrates 2. This large-sized substrate is provided beforehand with a grid of primary and secondary separation trenches extending vertically and horizontally, and each of cells defined by both separation trenches corresponds to one chip area. A large-sized substrate 2A as a representative portion corresponding to one chip area is illustrated in FIGS. 2A to 2E; however, practically, for a large-sized substrate whose size corresponds to the aggregation of a large number of chip areas, respective process steps which will be described below are performed in a single sequence.

Specifically, as is illustrated in FIG. 2A, the process forms the first front electrode 3 and the second front electrode 4 which are paired with each other by screen printing an Ag-based paste on the front surface of the large-sized substrate 2A, followed by drying and firing the paste (a step of forming the front electrodes). Additionally, simultaneously with or before or after this step of forming the electrodes, the process forms the back electrodes by screen printing the Ag-based paste on the back surface of the large-sized substrate 2A, followed by drying and firing the paste (a step of forming the back electrodes).

Next, as is illustrated in FIG. 2B, the process forms the resistive element 5 with its both longitudinal ends overlapping the first front electrode 3 and the second front electrode 4 by screen printing a resistive paste such as a ruthenium oxide paste and drying and firing the paste (a step of forming the resistive element). This resistive element 5 includes the meandering shaped connecting portion (the turn segment) 6 connecting to the first front electrode 3, the connecting portion 7 connecting to the second front electrode 4, and the first region 8 and the second region 9, which are rectangular in shape, connecting to both the connecting portions 6 and 7, respectively, and the first region 8 and the second region 9 are connected via the jointing section 10. Note that the order in which the step of forming the front electrodes and the step of forming the resistive element are performed may be reversed; after forming the resistive element 5, the process may form the first front electrode 3 and the second front electrode 4 so as to overlap the both ends of the resistive element 5.

Here, in FIGS. 2A to 2E, given that a direction in which the secondary separation trenches extend is an X direction and a direction in which the primary separation trenches extend is a Y direction, the connecting portion 6 depicted at left includes a lower horizontal part 6*a* extending in the X direction from the first front electrode 3, a vertical part 6*b* extending in the Y direction from the right edge of the lower horizontal part 6*a*, and an upper horizontal part 6*c* extending in the X direction from the top edge of the vertical part 6*b* and connecting to the top edge of the first region 8. In addition, the connecting portion 7 depicted at right extends in the X direction and makes a connection between the bottom edge of the second region 9 and the second front electrode 4, and the jointing section 10 extends in the X direction and makes a connection between the top edge of the first region 8 and the top edge of the second region 9.

Next, the process forms a precoating layer (omitted from the depiction) to cover the resistive element 5 by screen printing a glass paste from over the resistive element 5 and drying and firing the paste. After that, by irradiation with laser light from over the precoating layer, the process forms a first one of the first trimming grooves 11 in the first region 8, as is illustrated in FIG. 2C. The first one of the first trimming grooves 11 is an I-cut shaped slit formed to extend in the Y direction from the top side toward the bottom side of the first region 8, and this slit is formed along a straight line extending in the Y direction. Then, forming the first trimming groove 11 like this in the first region 8 elongates the current path throughout the resistive element 5. Thus, the resistive element 5 formed in a print shape having two meandering segments becomes to have a three-turn meandering shape at this point of time.

Subsequently, the process forms a second one of the first trimming grooves 11 which is shorter than the first one of the first trimming grooves 11 in the first region 8, as is illustrated in FIG. 2D. By these first and second ones of the first trimming grooves 11, the process roughly adjusts the resistance value of the resistive element 5 to a value that is somewhat lower than a target resistance value (a step of roughly adjusting the resistance value). The second one of the first trimming grooves 11 is formed in an area where there is less current distribution in the first region 8 after the first one of the first trimming grooves 11 has been formed and is an I-cut shaped slit extending in the Y direction from the top side toward the bottom side of the first region 8, as with the first one of the first trimming grooves 11. Note that the number of the first trimming grooves 11 that are formed in the first region 8 is not limited to two grooves and may be one groove or three or more grooves.

Next, the process forms the I-cut shaped second trimming groove 12 in the second region 9, as is illustrated in FIG. 2E. By this second trimming groove 12, the process finely adjusts the resistance value of the resistive element 5 to make it match the target resistance value (a step of finely adjusting the resistance value). The second trimming groove 12 is an I-cut shaped slit extending from the top side of the second region 9 at a certain angle θ of inclination with respect to the Y direction. Consideration is made so that the extremity of the second trimming groove 12 does not cross an imaginary line E connecting the jointing section 10 and the connecting portion 7 depicted at right at the shortest distance.

Here, a location where the largest amount of current flows within the second region 9 is along the imaginary line E. The second trimming groove 12 is formed in an area where there is less current distribution in the second region 9, and the direction in which it extends is angled with respect to the direction (Y direction) in which the first trimming grooves 11 extend. Owing to this, the second trimming groove 12 can be formed to extend long alongside the shortest current path (the imaginary line E). Accordingly, the amount of change in the resistance value depending on the cut depth of the second trimming groove 12 becomes small. It is possible to make a fine adjustment of the resistance value of the resistive element 5 at high precision. Additionally, it is preferable that the angle θ of inclination of the second trimming groove 12 with respect to the Y direction, in other words, the angle θ of inclination of a straight line along the direction in which the second trimming groove 12 extends with respect to a straight line along the direction (Y direction) in which the first trimming grooves 11 extend falls within a range from 1° to 3° ($1° \leq \theta \leq 3°$). If the angle θ of inclination becomes larger than the range, the amount of change in the resistance value per unit length depending on the cut depth of the second trimming groove 12 would become too small. This may result in that variation remaining after a rough adjustment of the resistance value by the first trimming grooves 11 cannot be finely adjusted satisfactorily by the second trimming groove 12.

Next, the process forms the protective coating layer, which is not depicted, to cover the whole of the resistive element 5 by screen printing a resin paste from over the first trimming grooves 11 and the second trimming groove 12 and thermally curing the paste (a step of forming the protective coating layer).

All the steps up to here are those of processing in a single sequence for the large-sized substrate 2A prepared to be separated into a large number of substrates. In the next step, the process performs primary breaking that separates the large-sized substrate 2A into strips along the primary separation trenches and obtains strip-like substrates, which are not depicted, each being provided with a plurality of chip areas (a primary separation step). Then, the process forms the end face electrodes, which are not depicted, to bridge the first and second front electrodes 3 and 4 and their mating back electrodes by sputtering a Ni/Cr layer onto the cut surfaces of the strip-like substrates (a step of forming the end face electrodes).

After that, the process performs secondary breaking that separates the strip-like substrates along the secondary separation trenches and thus obtains single chips, each of which is equivalent to the chip resistor 1 in size (a secondary separation step). Finally, the process applies electroplating (Ni plating and Sn plating) to the both longitudinal ends of the insulated substrate 2 of each of the single chips which are discrete ones and thus forms the external electrodes, which are not depicted, to cover the end face electrodes, the back electrodes, and the first and second front electrodes 3 and 4 exposed out of the protective coating layer. Thus, the chip resistor 1 as depicted in FIG. 1 is obtained.

As described hereinbefore, in the chip resistor 1 relevant to the first embodiment, after printing and forming the resistive element 5 having the first region 8 and the second region 9 which are rectangular in shape, the manufacturing process forms the first trimming grooves 11 in the first region 8 to elongate the current path of the resistive element 5. With improved anti-surge characteristics, the resistance value of the resistive element 5 can be roughly adjusted to approximate to the target value. Then, after the rough adjustment of the resistance value, the process forms the second trimming groove 12 in an area where there is less current distribution in the second region 9. In forming the groove, the direction in which the second trimming groove 12 extends is angled with respect to the direction in which the first trimming grooves 11 extend. Thereby, the second trimming groove 12 can be formed to extend long alongside the shortest current path (the imaginary line E). This results in a gradual change in the resistance value depending on the cut of the second trimming groove 12, and it is possible to make a fine adjustment of the resistance value at high precision and make yield improvement with reduced maladjustment of the resistance value.

In addition, in the chip resistor 1 relevant to the first embodiment, the first region 8 and the second region 9 which are the adjustment part are connected via the jointing section 10, and the area where the first trimming grooves 11 for rough adjustment are formed and the area where the second trimming groove 12 is formed are separate. Thus, a highly precise adjustment of the resistance value can be performed, the current path of the resistive element 5 becomes longer, and anti-surge characteristics can be improved. Furthermore, owing to the fact that the resistance value is roughly adjusted by the two first trimming grooves 11 formed in the region 8 and the second one of the first trimming grooves 11 is set shorter than the first one of the first trimming grooves 11, the chip resistor 1 with excellent withstand voltage (surge withstanding characteristics) can be realized.

Figure 3:
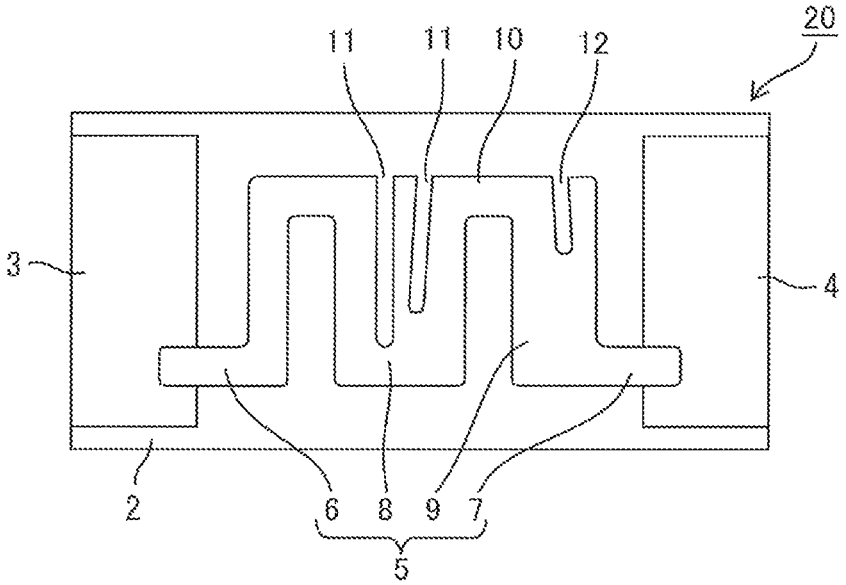
FIG. 3 is a plan view of a chip resistor relevant to a second embodiment.

FIG. 3 is a plan view of a chip resistor 20 relevant to a second embodiment of the present invention. Constituent parts corresponding to those in FIG. 1 are assigned identical reference numerals, and duplicated description thereof is omitted appropriately.

A point of difference of the second embodiment from the first embodiment lies in that two first trimming grooves 11 formed in the first region 8 do not extend in parallel with each other, and the second one of the first trimming grooves 11 is formed in a direction angled with respect to the first one of the first trimming grooves 11. The resistor structure other than this is basically the same as the chip resistor 1 depicted in FIG. 1.

Specifically, as is depicted in FIG. 3, the first one of the first trimming grooves 11 is formed to expend in the Y direction from the top side toward the bottom side of the first region 8. The second one of the first trimming grooves 1 is formed to extend from the top side of the first region 8 in a direction angled with respect to the Y direction. Note that the second trimming groove 12 that is formed in the second region 9 is angled with respect to the direction in which the first one of the first trimming grooves 11 extends, and the second one of the first trimming grooves 11 and the second trimming groove 12 are angled toward parting directions, respectively, with respect to the direction in which the first one of the first trimming grooves 11 extends.

In the thus configured chip resistor 20 relevant to the second embodiment, because the second one of the first trimming grooves 11 extends in the direction angled with respect to the first one of the first trimming grooves 11, there occurs a gradual change in the resistance value depending on the cut of the second one of the first trimming grooves 11, and a rough adjustment of the resistance value can be performed at higher precision. In addition, because micro cracks that are produced in the extremity of the second one of the first trimming grooves 11 are oriented toward the first one of the first trimming grooves 11, spreading of the micro cracks produced in the second one of the first trimming grooves 11 can be absorbed by the first one of the first trimming grooves 11.

Figure 4:
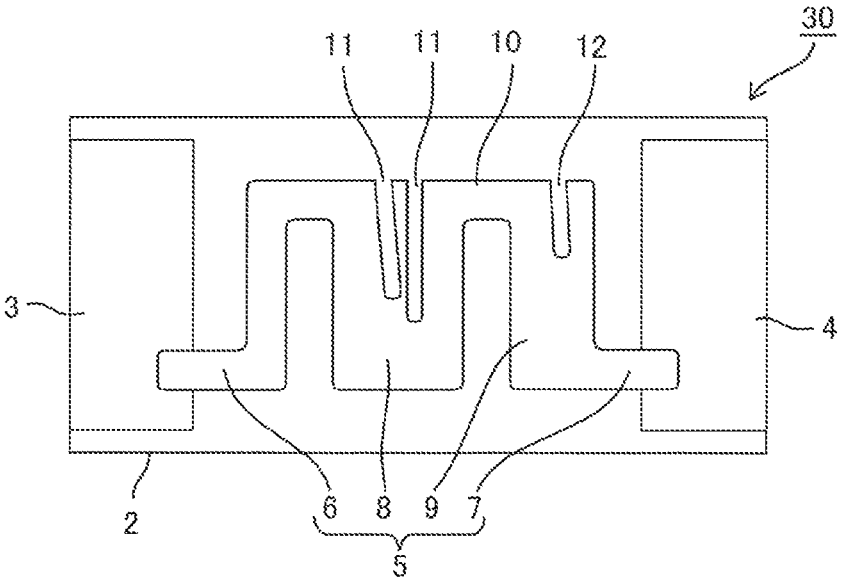
FIG. 4 is a plan view of a chip resistor relevant to a third embodiment.

Furthermore, while the second one of the first trimming grooves 11 is angled with respect to the first one of the first trimming grooves 11 in the chip resistor 20 relevant to the second embodiment, after the first one of the first trimming grooves 11 is formed to extend from the top side of the first region 8 in a direction angled with respect to the Y direction, the second one of the first trimming grooves 11 may be formed to extend in the Y direction from the top side toward the bottom side of the first region 8, as in a chip resistor 30 relevant to a third embodiment which is depicted in FIG. 4. In this case, by forming the second one of the first trimming grooves 11 longer than the first one of the first trimming grooves 11, spreading of micro cracks that are produced in the extremity of the first one of the first trimming grooves 11 is absorbed by the second one of the first trimming grooves 11.

Figure 5:
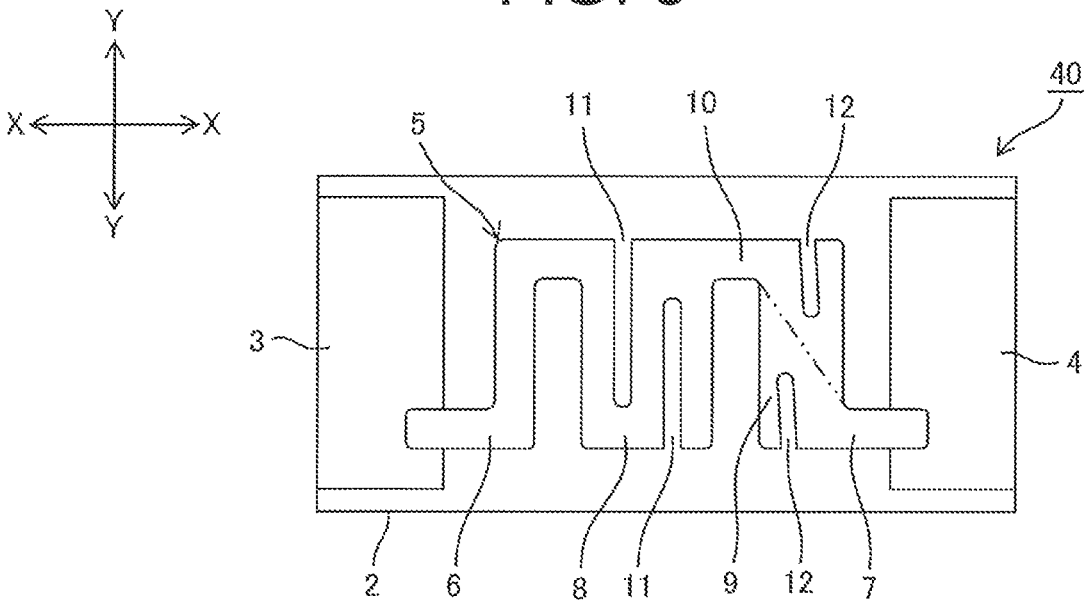
FIG. 5 is a plan view of a chip resistor relevant to a fourth embodiment.

FIG. 5 is a plan view of a chip resistor 40 relevant to a fourth embodiment of the present invention. Constituent parts corresponding to those in FIG. 1 are assigned identical reference numerals, and duplicated description thereof is omitted appropriately.

A point of difference of the fourth embodiment from the first embodiment lies in that two first trimming grooves 11 are formed toward opposite directions to each other, one originating from the top side of the first region 8 and the other originating from the bottom side of the first region 8, and that two second trimming grooves 12 are formed toward opposite directions to each other, one originating from the top side of the second region 9 and the other originating from the bottom side of the second region 9. The resistor structure other than this is basically the same as the chip resistor 1 depicted in FIG. 1.

Specifically, as is depicted in FIG. 5, a first one of the first trimming grooves 11 is formed to extend in the Y direction from the top side toward the bottom side of the first region 8, and a second one of the first trimming grooves 11 is formed to extend in the Y direction from the bottom side toward the top side of the first region 8. Thus, forming the two first trimming grooves 11 toward opposite directions to each other from the top and bottom sides of the first region 8 elongates the current routing path in the first region 8 and makes it possible to enhance anti-surge characteristics.

In addition, as for a fine adjustment of the resistance value, after a first one of the second trimming grooves 12 is formed to be angled with respect to the Y direction from the top side toward the bottom side of the second region 9, a second one of the second trimming grooves 12 is formed to be angled with respect to the Y direction from the bottom side toward the top side of the second region 9. Here, a location where the second one of the second trimming grooves 12 is formed is in an area where there is much less current distribution in the second region 9. Therefore, forming the second one of the second trimming grooves 12 allows a fine adjustment of the resistance value at extremely high precision. Furthermore, the second one of the second trimming grooves 12 is also set to a position where it does not cross the imaginary line E, and both the first and second ones of the second trimming grooves 12 are formed alongside the shortest current path (the imaginary line E).

Figure 6:
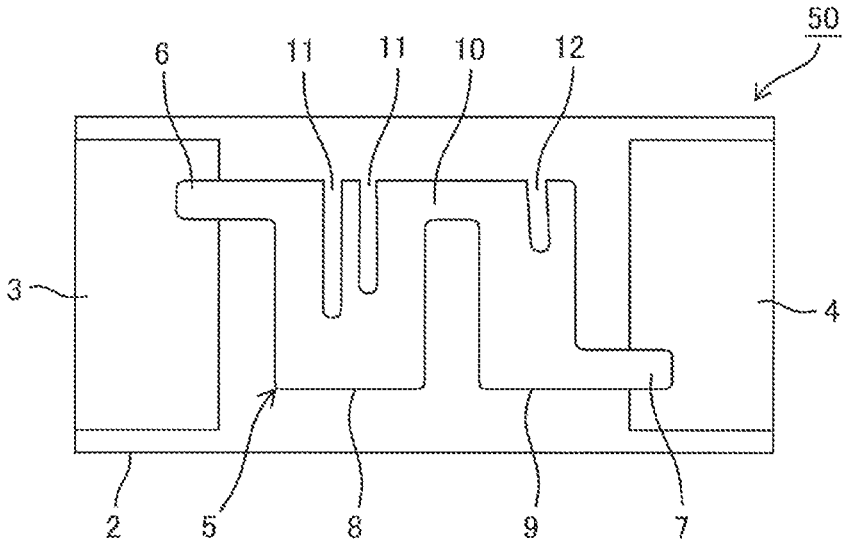
FIG. 6 is a plan view of a chip resistor relevant to a fifth embodiment.

FIG. 6 is a plan view of a chip resistor 50 relevant to a fifth embodiment of the present invention. Constituent parts corresponding to those in FIG. 1 are assigned identical reference numerals, and duplicated description thereof is omitted appropriately.

A point of difference of the fifth embodiment depicted in FIG. 6 from the first embodiment lies in that a pair of the both connecting portions 6 and 7 is formed as a linear pattern. The resistor structure other than this is basically the same as the chip resistor 1 depicted in FIG. 1. Specifically, the connecting portion 6 depicted at left is a linear pattern that makes a connection between the first front electrode 3 and the top edge of the first region 8, and the connecting portion 7 depicted at right is a linear pattern that makes a connection between the second front electrode 4 and the bottom edge of the second region 9. The resistive element 5 made in a shape like this also allows a fine adjustment of the resistance value at high precision with improved anti-surge characteristics by forming the first trimming grooves 11 for rough adjustment in the first region 8, followed by forming the second trimming groove 12 for fine adjustment extending in a direction angled with respect to the first trimming grooves 11 in the second region 9.

Figure 7:
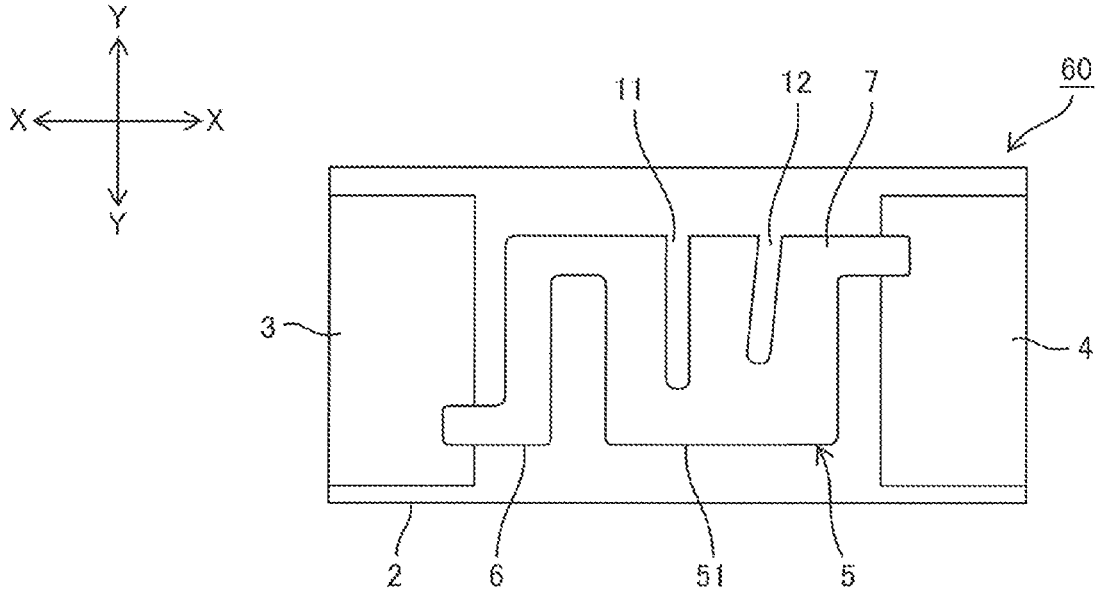
FIG. 7 is a plan view of a chip resistor relevant to a sixth embodiment.
Figure 8:
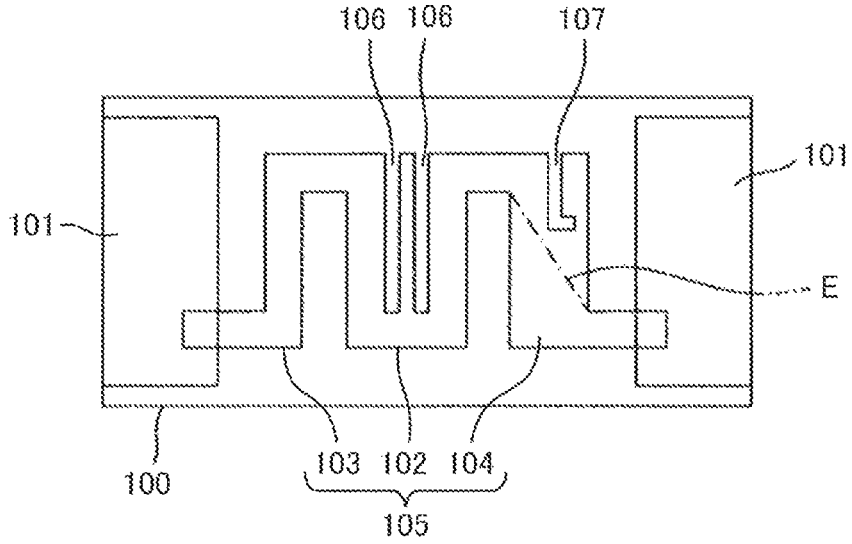
FIG. 8 is a plan view of a chip resistor relevant to the related art.

FIG. 7 is a plan view of a chip resistor 60 relevant to a sixth embodiment of the present invention. Constituent parts corresponding to those in FIG. 1 are assigned identical reference numerals, and duplicated description thereof is omitted appropriately.

A point of difference of the sixth embodiment depicted in FIG. 7 from the first embodiment lies in that a first trimming groove 11 and a second trimming groove 12 are formed in a single adjustment part 51. The resistor structure other than this is basically the same as the chip resistor 1 depicted in FIG. 1. Specifically, the resistive element 5 includes the connecting portion 6 depicted at left extending in a meandering shape, the connecting portion 7 depicted at right extending linearly, and the adjustment part 51 which is rectangular in shape formed between these connecting portions 6 and 7. In this adjustment part 51, the first trimming groove 11 for rough adjustment and the second trimming groove 12 for fine adjustment are formed. The resistive element 5 made in a shape like this also allows a fine adjustment of the resistance value at high precision with improved anti-surge characteristics by forming the first trimming groove 11 to extend in the Y direction from the top side toward the bottom side of the adjustment part 51, followed by forming the second trimming groove 12 so as to be angled with respect to the Y direction from the top side toward the bottom side of the adjustment part 51.

Note that the present invention is not limited to the foregoing embodiments, and various modifications can be made thereto without departing from the technical scope of the invention. For example, the shape of the first trimming grooves 11 for rough adjustment is not limited to the I-cut shape and may be any shape with a linear slit, such as an L-cut shape or a J-cut shape having the turned extremity of the linear slit.

In addition, in the case of the chip resistor in which the resistive element has the meandering shaped connecting portion, as in the first or fourth embodiment, size reduction of the chip resistor narrows the clearance between the resistive element and the front electrodes and increases the influence of blurry in printing the resistive element. In such a case, the front electrodes may be placed farther away on the side of the connecting portions to widen the clearance (increase the distance) between the resistive element and the front electrodes.

DESCRIPTION OF THE REFERENCE NUMERALS

1, 20, 30, 40, 50, 60 chip resistor
2 insulated substrate
2A large-sized substrate
3 first front electrode
4 second front electrode
5 resistive element
6, 7 connecting portion
8 first region
9 second region
10 jointing section
11 first trimming groove
12 second trimming groove
51 adjustment part

What is claimed is:

1. A chip resistor comprising:

an insulated substrate having a rectangular parallelepiped shape;

a pair of electrodes placed opposing each other across a certain distance on the insulated substrate; and a resistive element making a bridge connection between the pair of electrodes with a trimming groove extending linearly in the resistive element to make a resistance value adjustment, wherein the resistive element is an element formed by printing having connecting portions connecting to the pair of the electrodes and an adjustment part which is rectangular in shape positioned between both the connecting portions;

in the adjustment part, a first trimming groove for rough adjustment is formed to elongate a current path of the resistive element and a second trimming groove for fine adjustment is formed to adjust a resistance value after being roughly adjusted by the first trimming groove;

the first trimming groove and the second trimming groove extend from one common side or two opposing sides of the adjustment part as their respective starting point;

the first trimming groove and the second trimming groove do not touch each other; and a straight line along a direction in which the second trimming grove extends is angled with respect to a straight line along a direction in which the first trimming groove extends, with an angle of inclination being greater than zero and smaller than 90°.

2. The chip resistor according to claim 1, wherein at least one of the connecting portions is made as a turn segment extending in a meandering shape.

3. The chip resistor according to claim 1, wherein the adjustment part has a first region and a second region continuing in series via a jointing portion, the first trimming groove is formed in the first region, and the second trimming groove is formed in the second region.

4. The chip resistor according to claim 3, wherein, as the first trimming groove, a plurality of first trimming grooves that are I-cut shaped and have different length dimensions are formed in the first region.

5. The chip resistor according to claim 4, wherein, as the first trimming groove, two first trimming grooves are formed in the first region and one of the first trimming grooves is angled with respect to the other one of the first trimming grooves.

6. The chip resistor according to claim 3, wherein, as the first trimming groove, two first trimming grooves are formed in the first region and the two first trimming grooves extend in opposite directions to each other originating from top and bottom opposing sides of the first region.

7. A method of manufacturing a chip resistor including an insulated substrate, a first electrode and a second electrode placed opposing each other across a certain distance on the insulated substrate, and a resistive element making a bridge connection between the first electrode and the second electrode with a trimming groove extending linearly in the resistive element to make a resistance value adjustment, wherein the resistive element includes an element formed by printing having a turn segment connecting to the first electrode and extending in a meandering shape, a first region which is rectangular in shape and connects to the turn segment, a second region which is rectangular in shape and connects to the second electrode, and a jointing portion making a connection between the first region and the second region, and the method comprises:

forming in the first region a first trimming groove for rough adjustment to elongate a current path of the resistive element;

subsequently forming in the second region a second trimming groove, wherein the first trimming groove and the second trimming groove extend from one common side of the first and second regions or from two opposing sides of the first and second regions as their respective starting point, the first trimming groove and the second trimming groove do not touch each other, and a straight line along a direction in which the second trimming groove extends is angled with respect to a straight line along a direction in which the first trimming groove extends, with an angle of inclination being greater than zero and smaller than 90°; and thereby making a fine adjustment of a resistance value after being roughly adjusted by the first trimming groove so that the resistance value falls within a target resistance value range.

8. The chip resistor according to claim 2, wherein the adjustment part has a first region and a second region continuing in series via a jointing portion, the first trimming groove is formed in the first region, and the second trimming groove is formed in the second region.

9. The chip resistor according to claim 8, wherein, as the first trimming groove, a plurality of first trimming grooves that are I-cut shaped and have different length dimensions are formed in the first region.

10. The chip resistor according to claim 9, wherein, as the first trimming groove, two first trimming grooves are formed in the first region and one of the first trimming grooves is angled with respect to the other one of the first trimming grooves.

11. The chip resistor according to claim 8, wherein, as the first trimming groove, two first trimming grooves are formed in the first region and the two first trimming grooves extend in opposite directions to each other originating from top and bottom opposing sides of the first region.

* * * * *